United States Patent [19]

Huggins et al.

[11] Patent Number: 4,943,043

[45] Date of Patent: Jul. 24, 1990

[54] STACKER

[75] Inventors: Orville C. Huggins, Dayton; John D. Mistyurik, Tipp City, both of Ohio

[73] Assignee: Monarch Marking Systems, Inc., Dayton, Ohio

[21] Appl. No.: 364,287

[22] Filed: Jun. 12, 1989

Related U.S. Application Data

[62] Division of Ser. No. 907,263, Sep. 15, 1986, abandoned.

[51] Int. Cl.[5] ..... B65H 31/00

[52] U.S. Cl. ..... 271/212; 271/213; 271/224

[58] Field of Search ..... 271/207, 290, 292, 209, 271/212, 162, 163, 164, 208, 213, 224; 439/310; 414/789.9

[56] References Cited

U.S. PATENT DOCUMENTS

| | | | |
|---|---|---|---|
| 3,989,236 | 11/1976 | Komori | 271/163 X |
| 4,083,619 | 4/1978 | McCormick | 439/310 |
| 4,275,876 | 6/1981 | Imaizumi | 271/207 X |
| 4,425,068 | 1/1984 | Wilson | 271/212 X |
| 4,650,177 | 3/1987 | Hauger | 271/290 X |
| 4,655,446 | 4/1987 | Heindke | 271/314 |

*Primary Examiner*—Richard A. Schacher
*Attorney, Agent, or Firm*—Joseph J. Grass

[57] ABSTRACT

There is disclosed a stacker for tags received from a tag dispensing device. The stacker has an improved feed mechanism with a self-clutching feature and an adjustable end wall member. The printer is adapted to be releasably secured to tag dispensing device, such as a printer.

12 Claims, 5 Drawing Sheets

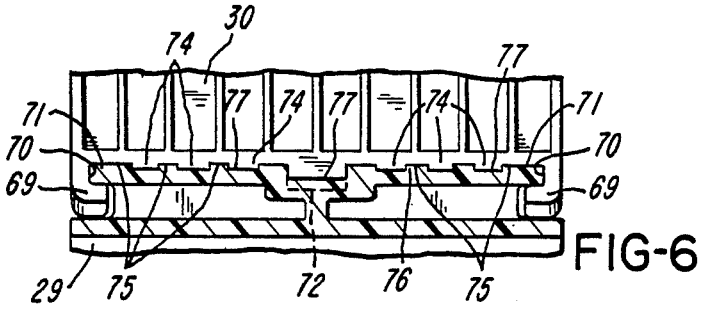
FIG-6
FIG-4
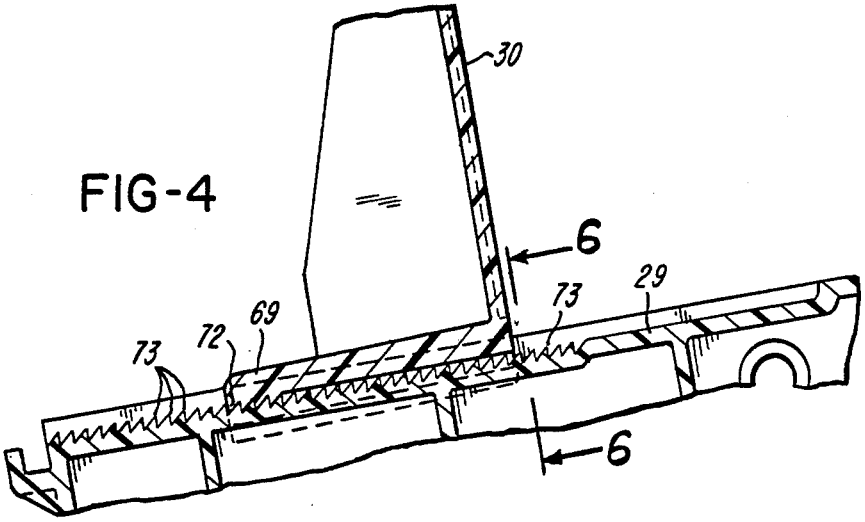
FIG-5
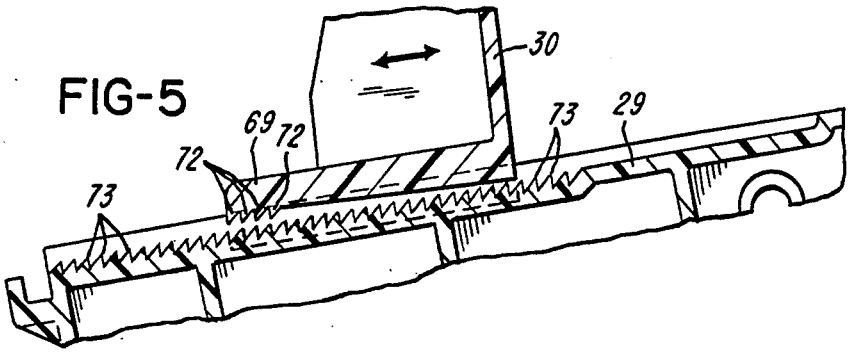

STACKERcl CROSS-REFERENCE TO RELATED APPLICATIONS

This application is a divisional application based on parent U.S. patent application Ser. No. 907,263 filed Sept. 15, 1986, now abandoned, and refiled as continuation application Ser. No. 364,600 filed June 12, 1989.

BACKGROUND OF THE INVENTION

1. Field of the Invention

This invention relates to the field of stackers for tags.

2. Background of the Invention

The following prior art U.S. patent is made of record: 3,874,650 granted to Steigerwald et al on Apr. 1, 1975.

SUMMARY OF THE INVENTION

The invention relates to an improved stacker for stacking tags received from a tag dispensing device.

The improved stacker of the invention includes structure for self-clutching the tags so that in the event the tag dispensing device issues tags faster than the rate of feed of the stacker feed mechanism no damage to the tag or the stacker will result. Also in the event of a jam of the incoming tag with other tags in the hopper of the stacker the feeding mechanism can slip relative to the tag because of the self-clutching feature.

The improved stacker includes an adjustable end wall member against which the leading ends of the tags abut. The adjustment is simple and easy to use and enables the stacker hopper to accommodate tags of various lengths The improved stacker has mechanism for attaching the stacker releasably to the tag dispensing device, e.g. a printer. The stacker has grippers which can grip a cam shaft which in turn is used to draw the stacker into fully coupled relationship, with electrical connectors of the stacker and the printer fully connected.

Other features of the invention are readily apparent from the description which follows and from the diagrammatic drawings herewith.

BRIEF DESCRIPTION OF THE DRAWINGS

FIG. 4 is a vertical sectional view showing fragmentary portions of the bottom member and the end wall member, with the end wall member held against generally leftward movement;

FIG. 5 is a view similar to FIG. 4, but showing the end wall member in a position wherein the end wall member can be moved either generally leftward or generally rightward.

FIG. 6 is a sectional view taken generally along line 6—6 of FIG. 4;

DESCRIPTION OF THE PREFERRED EMBODIMENT

Figure 1:
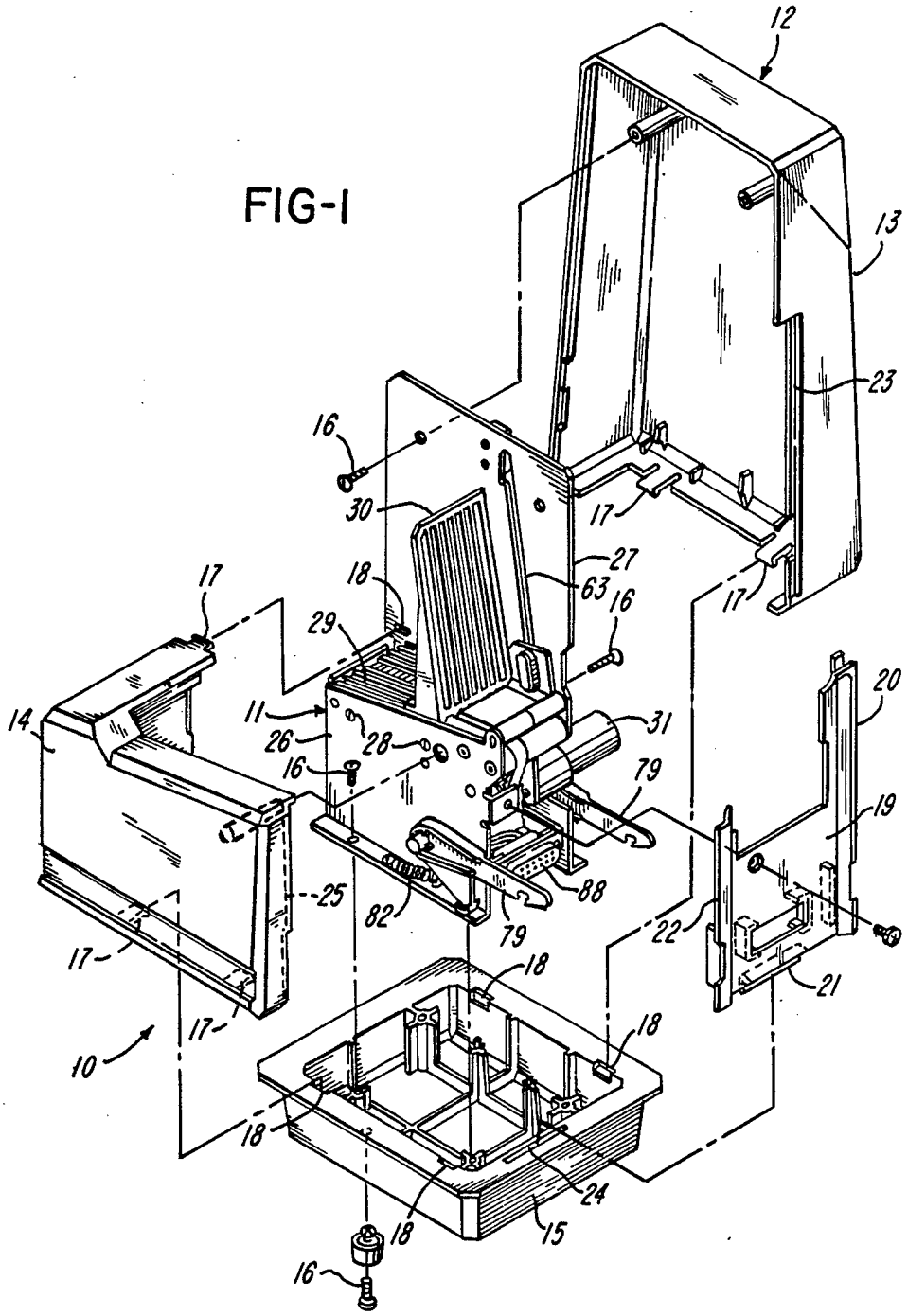
FIG. 1 is a partially exploded perspective view of a stacker in accordance with the invention.

Referring to FIG. 1 there is shown a stacker generally indicated at 10. The stacker 10 includes a frame generally indicated at 11 and a housing generally indicated at 12. The housing 12 includes side covers 13 and 14 and a base 15. The base 15 is secured to the frame 11 by various screws 16 and flexible resilient snap members 17 received in recesses 18. A front cover 19 has flanges 20, 21 and 22 held captive in respective grooves 23, 24 and 25. The stacker frame 11 includes a spaced pair of plates 26 and 27 secured by screws 28 to an intervening bottom member 29. An end wall member 30 is adjustably positioned on the bottom member 29.

Figure 2:
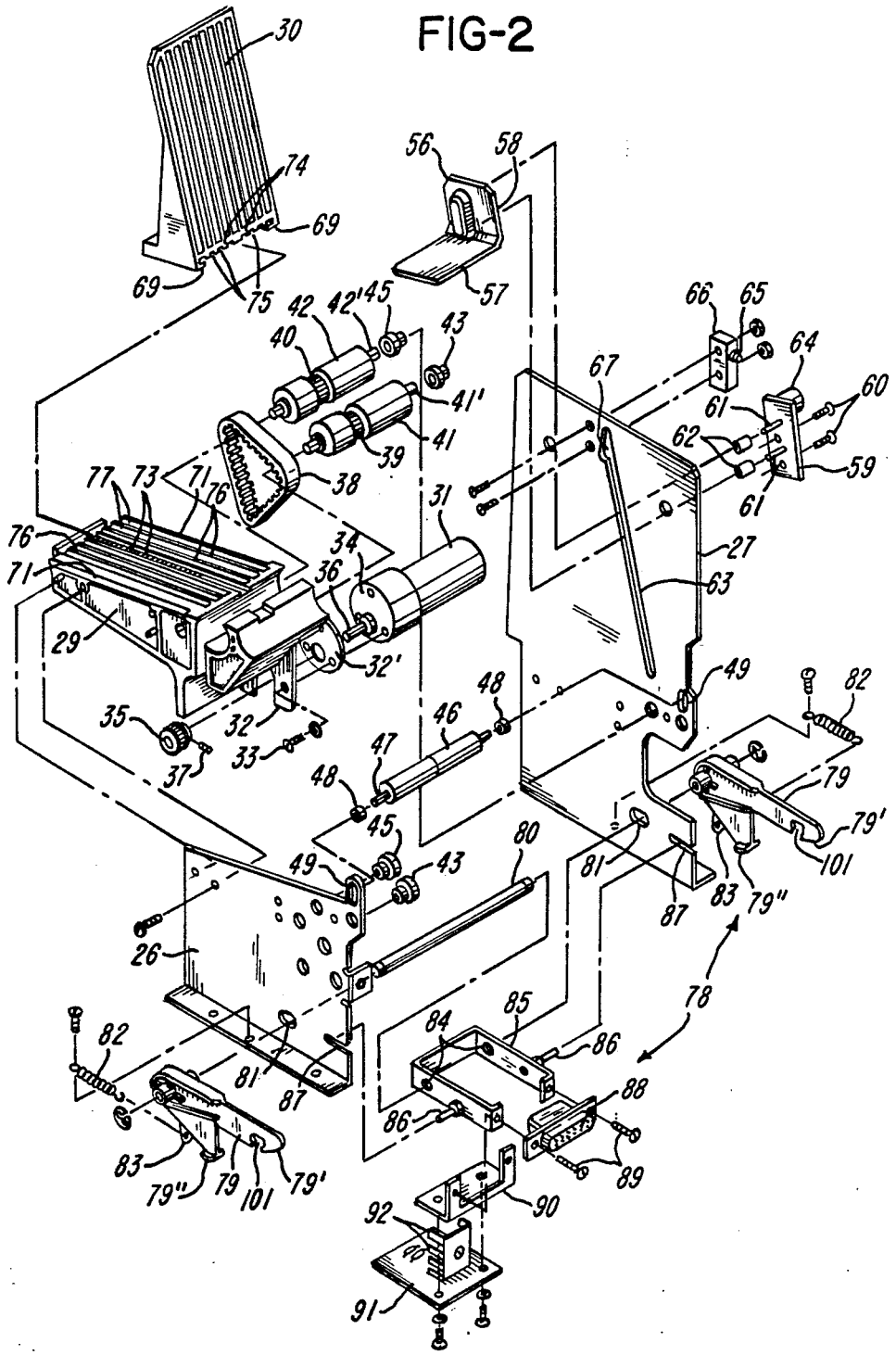
FIG. 2 is an exploded perspective view of a portion of the stacker shown in assembled form in FIG. 1.

With reference to FIG. 2, an electric motor 31 such as a stepping motor is mounted to a depending U-shaped flange 32 on the bottom member 29. Three screws 33 (only one of which is shown) secure the motor 31 to the flange 32. An elastomeric member 32' is disposed between end portion 34 of the motor 31 and the flange 32 to dampen vibrations. A toothed wheel 35 is secured to motor shaft 36 by a set screw 37. A toothed belt 38 engages the toothed wheel 35 and engages toothed wheels 39 and 40 which drive respective rolls 41 and 42. The toothed wheel 39, the roll 41 and a mounting shaft 41' rotate as a unit. The shaft 41' is rotatable in bearings 43 mounted in plates 26 and 27. The toothed wheel 40, the roll 42 and a mounting shaft 42' rotate as a unit. The shaft 42' is rotatable in bearings 45 mounted in plates 26 and 27. Counterclockwise rotation of the motor shaft 36 causes counterclockwise rotation of the rolls 41 and 42 as viewed in FIGS. 2 and 3. A roll 46 is secured to a shaft 47 which receives spacers 48. The end portions of the shaft 47 are received in elongate vertical slots 49 in plates 26 and 27. The roll 46 bears gravitationally against a tag T entering the stacker 10 from a source of tags, for example a printer generally indicated at 50. A web W of tag stock is advanced by a driven platen roll 51. A thermally sensitive ink ribbon R is disposed between a thermal print head 52 and the web W. Data is printed by the print head 52 as the platen roll 51 rotates. A printed tag T is severed by a cutting mechanism generally indicated at 53.

Figure 3:
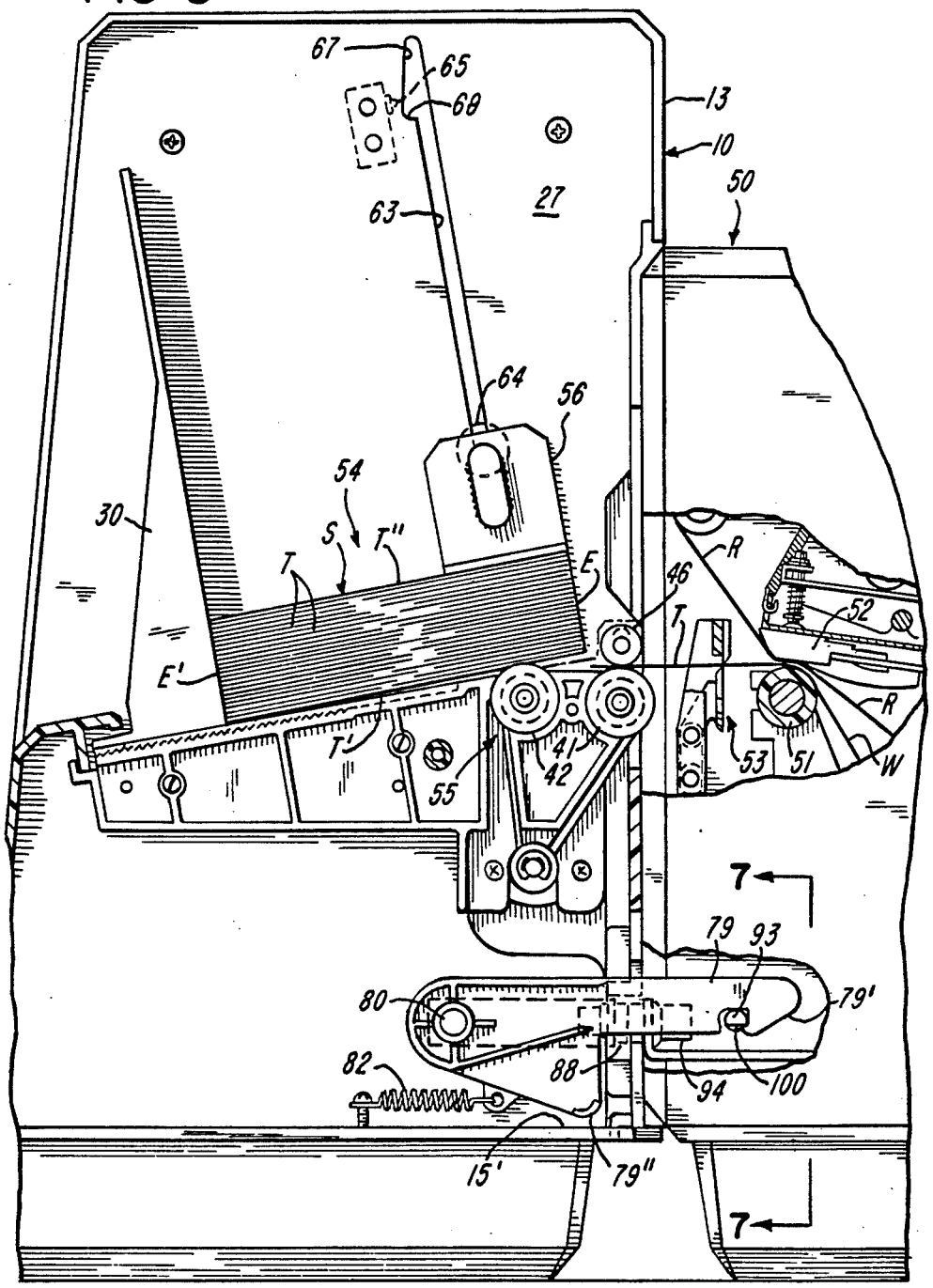
FIG. 3 is an elevational view of the stacker and a fragmentary portion of a printer.

A tag T is first received by the stacker 10 when the tag T passes between rolls 41 and 46. Operation of the motor 31 and counterclockwise rotation of the roll 41 causes the tag T to be conveyed into the hopper 54 of the stacker 10. Continued rotation of the roll 41 causes the tag T to pass into contact with the roll 42 beneath the bottom tag T of a stack S of tags T. The stack S thus presses the incoming tag T against the roll 42. The rolls 41 and 42 are preferably comprised of an elastomeric frictional material so that they can grip the incoming tag T. The rolls 41, 42 and 46, the motor 31 and associated structure comprise a conveyor generally indicated at 55. As shown in FIG. 3 the incoming tag T enters the stack S at an acute angle with respect to the bottom tag T' in the stack S. Therefore, the incoming tag T cannot bump into the front edge E of the stack S. The end wall 30 is adjusted so that the roll 42 is in continuous contact with the incoming tag T until the leading end of the incoming tag T abuts the end wall 30. The end wall 30 is adjusted so that the roll 42 supports the bottom tag T' between edges E and E'. The frictional nature of the outer surface of the rotating roll 42 is such that slippage of the roll 42 occurs with respect to the bottom tag T' in the stack when the bottom tag T' abuts the end wall 30.

The rolls 41 and 46 cooperate on a self-clutching basis to promote smooth operation between the printer 50 and the stacker 10. The roll 46 presses the incoming tag T only lightly against the roll 41. Such light pressing is sufficient to advance a tag T which has been cut off by the cutting mechanism 53. This self-clutching feature results from the fact that the roll 46 is capable of slight separational movement with respect to the roll 41. However, if the printer 50 stops while the motor 31 is operating, or if the speed of advance of the incoming tag T is either greater or lesser than the peripheral speed of the roll 41, no damage will occur to the printer 50, the stacker 10, or the tag T because the roll 41 will slip relative to the tag T. The self-clutching feature is important to smooth cooperation between the printer 50 and the stacker 10. Each of the rolls 41 and 46 serves to guide the tags T into the hopper 54 of the stacker 10.

A weight 56 rests on the top tag T″ of the stack S in force opposition to the supporting force exerted by the roll 42. As tags T are fed into the bottom of the hopper 54, the size of the stack S increases and the weight 56 is raised. The weight 56 is generally L-shaped as best shown in FIG. 2. The weight 56 has a base portion 57 joined to a mounting portion 58. A plate 59 is secured to the mounting portion 58 by screws 60. The plate 59 mounts a pair of shafts 61 which mount rollers 62. The rollers 62 are guided in an elongated slot 63. The plate 59 also mounts a cam 64 which operates an actuator 65 of a switch 66 when the weight 56 reaches the top portion of the hopper 54. The slot 63 is sloped at the same angle with respect to the vertical as the end wall 30 as best shown in FIG. 3. The top portion of the slot 63 has an enlarged opening 67 with a land 68. The weight 56 can be manually positioned so that the lower roller 62 is held supported by the land 68, and in this position of the weight 56, the roller 64 is retained against the button 65 to hold the switch 66 closed.

As best shown in FIGS. 2 and 6, the end wall member 30 has a pair of opposed channel-shaped member 69 having channels 70 which receive outwardly extending flanges 71 on the bottom member 29. The channels 70 diverge toward the left and the flanges 71 have a constant thickness to enable the end wall member 30 to be tilted from the position shown in FIG. 4 to the position shown in FIG. 5. As shown in FIGS. 4 and 6, the right ends of the channel-shaped members 69 have just normal clearance to enable the end wall member 30 to be shifted either to the left or right when the end wall member has been tilted to the position shown in FIG. 5. On the other hand, the channel 70 diverges sufficiently to enable the end wall member 30 to be tilted to the FIG. 5 position to enable the teeth 72 on the end wall member 30 to move clear of longitudinally spaced teeth 73 on the bottom member 29. The teeth 72 are formed by ridges and grooves in the underside of the end wall member 30, and the teeth 73 are formed by ridges and grooves on the upper side of the bottom member 29. As best shown in FIG. 4, the teeth 72 are shown engaged with the teeth 73 to prevent leftward movement of the end wall member 30. The inclination of the wall 30 with respect to the vertical is advantageous in holding the teeth 72 engaged with the teeth 73 until such time as it is desired to adjust the end wall member 30 longitudinally relative to the bottom member 29. The range of adjustment is determined by the longitudinal extent of the teeth 73 and the number of teeth 72. At least one tooth 72 and preferably a plurality of teeth 72, as shown, are provided.

The bottom surface of the end wall member 30 has a series of longitudinally extending parallel ridges 74 and intervening grooves 75. The upper surface of the bottom member 29 has a series of longitudinally extending parallel ridges 76 and intervening grooves 77. The ridges 74 are received in grooves 77 and the ridges 76 are received in grooves 75. By this arrangement it is impossible for an incoming tag T to be fed between the bottom of the end wall member 30 and the top of the bottom member 29.

With reference to FIG. 2, there is shown structure generally indicated at 78 for releasably holding or connecting the stacker 10 to the printer 50. The structure 78 is shown to include a pair of grippers 79 pivotally mounted on a shaft or pivot 80. The shaft 80 is slidably mounted in horizontally extending elongated guide slots 81 in plates 26 and 27. The grippers 79 are pivoted clockwise (FIGS. 2, 3 and 8) by tension springs 82. The springs 82 are connected to respective depending tangs 83 on the grippers 79 and to plates 26 and 27. The shaft 80 is received in holes 84 in a holder 85. The holder 85 mounts guides 86 received in horizontal slots 87 in plates 26 and 27. Thus, the slots 81 and 87 guide the shaft 80 and the guides 86 respectively to in turn guide the holder 85 for horizontal movement. An electrical connector 88 is secured to the holder by screws 89. The screws 89 also secure a bracket 90 to the holder 85. The bracket mounts a plate 91 which has a series of contacts 92 connected to the motor 31 and to the switch 66. The contacts 92 are electrically connected to the electrical connector 88.

Figure 7:
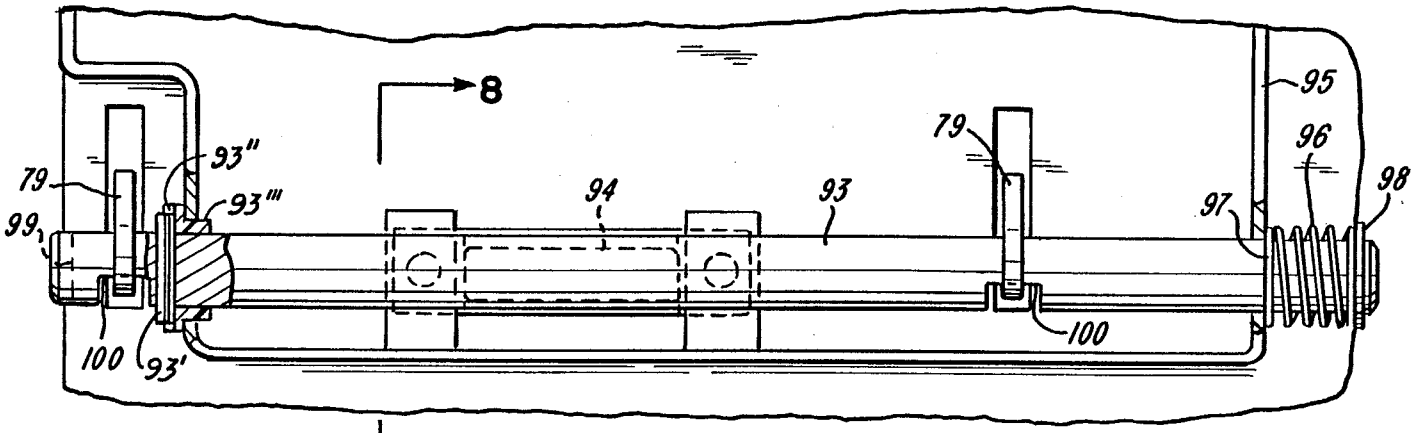
FIG. 7 is a view taken generally along line 7—7 of FIG. 3.
Figure 8:
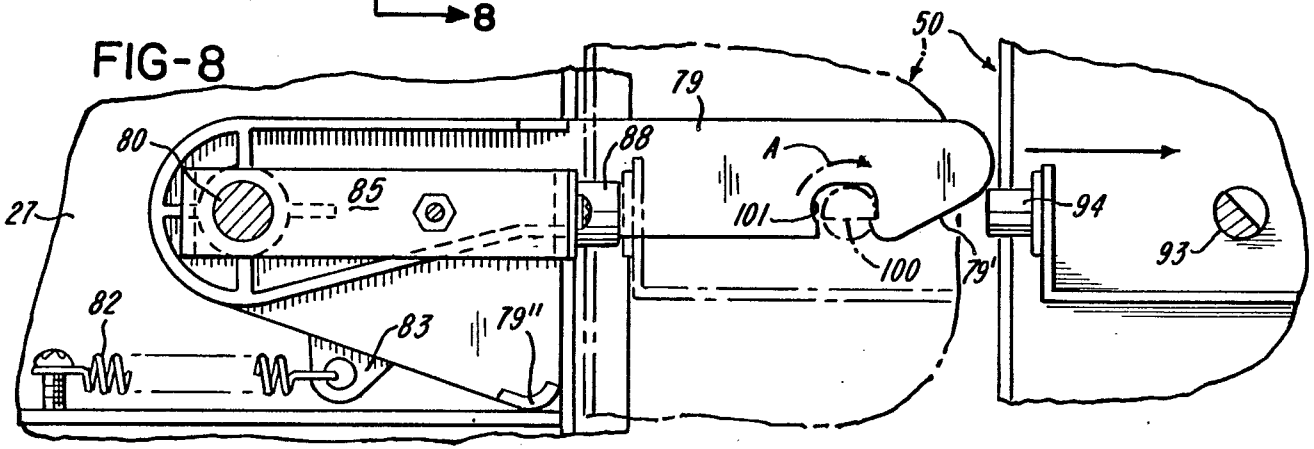
FIG. 8 is a sectional view taken generally along line 8—8 of FIG. 7.

FIGS. 3, 7 and 8 show a cam or cam shaft 93 cooperable with the grippers 79 to draw the stacker 10 toward the printer 50 and to electrically connect the electrical connector 88 fully with an electrical connector 94 on the printer 50 as shown in FIG. 3. The shaft 93 is pivotally mounted in the printer frame 95. The shaft 93 is held detented in one of two positions by a pin 93′ which passes through and is secured in the shaft 93 and cooperates with one of two detent grooves 93″ in a detent member 93″. A spring 96 acts against a washer 97 and a clip 98 and urges the shaft 93 to the right in FIG. 7. The shaft 93 is rotatable by inserting a tool such as a screw driver into a slot 99 and turning the screw driver. The shaft 93 is round except for flats 100 gripped by the grippers 79. Before the stacker 10 is connected to the printer 50, the shaft 93 is positioned with its flats 100 as shown in solid lines in FIG. 8. Thereupon, the stacker 10 is moved into alignment with the printer 50 with its electrical connectors 88 and 94 in alignment. The grippers 79 have cam faces 79′ which contact the cam shaft 93 during connection of the stacker 10 into coupled relationship to cam and pivot the gripper 79 against the action of springs 82. Each gripper 79 has a foot 79″ acting on a surface 15′ to provide a stop against excessive clockwise movement (FIG. 3) of the grippers 79. The stacker 10 is gently pushed into connected relationship with respect to the printer 50. To assure final alignment and that the stacker 10 is held coupled to the printer 50, the user rotates the shaft 93 through 135° to the position shown in FIGS. 3 and 7 in solid lines and in FIG. 8 in phantom lines. As shown, the grippers 79 have hook-shaped slots 101. Rotation of the shaft 93 in the direction of arrow A pulls the grippers 79 to the right in FIG. 8. Because the shaft 80 bottoms at the one ends of the slots 81, movement of the grippers 79 to the right in FIG. 3 causes the stacker 10 to be drawn toward and into fully coupled relationship with respect to the printer 50. Release of the stacker 10 from the printer 50 is accomplished by rotating the shaft 93 through 135° in a direction opposite to arrow A, namely counterclockwise.

Other embodiments and modifications of the invention will suggest themselves to those skilled in the art, and all such of these as come within the spirit of this invention are included within its scope as best defined by the appended claims.

We claim:

1. A stacker for stacking tags, comprising: a frame, a hopper mounted on the frame for receiving a stack of tags, means for feeding tags one at a time into the hopper, means for releasably attaching the stacker to a source device of tags, a first electrical connector on the attaching means adapted to be electrically coupled to a second electrical connector on the source device, wherein the attaching means includes a holder, a gripper mounted on the holder and adapted to grip the source device, the first electrical connector being mounted on the holder, means for movably mounting the holder, and means on the source device for drawing on the gripper to pull the first and second electrical connectors into electrically coupled relationship.

2. A stacker as defined in claim 1, wherein the drawing means includes a cam engageable with the gripper.

3. A stacker as defined in claim 1, wherein the gripper is spring-loaded.

4. A stacker as defined in claim 1, including a pair of said grippers.

5. A stacker, comprising: a hopper adapted to receive a stack of tags, means for feeding tags into the bottom of the hopper, a weight for resting on the top of the stack, a guide for the weight, a switch at the top of the guide for disabling the feeding means, wherein the guide has means for allowing the weight to be shifted and held at the top of the guide in cooperation with the switch to keep the feeding means disabled.

6. In combination, a stacker for stacking tags, the stacker including an electrically driven conveyer, and a first electrical connector, a source device for delivering tags to the stacker including a second electrical connector, and means partly on the stacker and partly on the source device for drawing the first and second electrical connectors into electrically coupled relationship.

7. The combination defined in claim 6, wherein the drawing means includes a gripper and a cam cooperable with the gripper for drawing on the gripper.

8. The combination defined in claim 6, wherein the drawing means includes a pair of grippers on the stacker and a cam shaft on the source device and cooperable with the grippers.

9. The combination defined in claim 8, including means for detenting the cam shaft in selected positions.

10. In combination, a stacker for stacking tags, a source device for delivering tags to the stacker, means for releasably attaching the stacker and the source device, wherein the attaching means includes means for drawing the stacker and the source device toward each other into aligned coupled relationship, wherein the drawing means includes a gripper, a cam engageable by the gripper, a cam face on the gripper, and the cam face being cooperable with the cam while the stacker and the source device are being attached to cam the gripper and the cam into cooperable relationship in which the stacker and the source device can be drawn relatively toward each other.

11. In combination, a stacker for stacking tags, a source device for delivering tags to the stacker, means for releasably attaching the stacker and the source device, wherein the attaching means includes means for drawing the stacker and the source device toward each other into aligned coupled relationship, wherein the attaching means includes a holder, means for movably mounting the holder on the stacker for movement toward and away from the source device, means for biasing the holder away from the source device, a pair of grippers mounted on the holder, a cam shaft on the source device engageable by the grippers, and means for rotating the cam shaft to cause the stacker and the source device to be held in attached relationship.

12. In combination, a stacker for stacking tags, a source device for delivering tags to the stacker, means for releasably attaching the stacker and the source device, wherein the attaching means includes means for drawing the stacker and the source device toward each other into aligned coupled relationship, an electrical connector on the source device and a cooperable electrical connector on the stacker, and wherein the drawing means draws the electrical connectors into coupled relationship.

* * * * *